US006227912B1

(12) United States Patent
Hung

(10) Patent No.: US 6,227,912 B1
(45) Date of Patent: May 8, 2001

(54) STRUCTURE OF LAMP SOCKET

(76) Inventor: Shin-Ming Hung, 9F, No. 52, Shuiyusn Rd., Sec. 2, Hsichin Town, Taipei Hsien (TW)

( * ) Notice: Subject to any disclaimer, the term of this patent is extended or adjusted under 35 U.S.C. 154(b) by 0 days.

(21) Appl. No.: 09/499,000

(22) Filed: Feb. 4, 2000

(51) Int. Cl.[7] ..... H01R 13/66
(52) U.S. Cl. ..... 439/620; 439/667; 200/51.17
(58) Field of Search ..... 439/620, 666, 439/667; 200/51 R, 51.14, 51.17

(56) References Cited

U.S. PATENT DOCUMENTS 1,522,148 * 1/1925 Seltzer ..... 200/51.17
5,150,008 * 9/1992 Lee ..... 315/71
5,783,788 * 7/1998 Jones et al. ..... 200/51.17

* cited by examiner

*Primary Examiner*—Khiem Nguyen
(74) *Attorney, Agent, or Firm*—Pro-Techtor International Services

(57) ABSTRACT

A lamp socket includes a plastic socket shell having a big opening and a small opening, a partition board with a center metal spring and a metal socket body connected to the plastic socket shell, a metal block fixedly provided at one side of the plastic socket shell and connected to the metal socket body by rivet means for the connection of one AC wire, wherein the plastic socket shell has a rectangular chamber at a top side thereof, a diode is mounted in the rectangular chamber; a rotary switch control knob inserted through the small opening into the big opening and rotated to disconnect electric current from the bulb being installed in the metal socket body, to connect electric current to the bulb without through the diode, or to connect electric current to the bulb via the diode.

4 Claims, 7 Drawing Sheets

STRUCTURE OF LAMP SOCKET

BACKGROUND OF THE INVENTION

The present invention relates to electric elements, and more specifically to a lamp socket.

A conventional lamp socket A, as shown in FIG. 8. comprises a rotary switch control knob A1 rotated to turn on/off the tungsten bulb B installed therein. Because the rotary switch control knob A1 simply controls on/off status of the bulb B, the bulb B provides only a fixed intensity of light.

SUMMARY OF THE INVENTION

The present invention provides an improved structure of lamp socket, which can be turned between three status, namely, the off status, the full light intensity status, and the half light intensity status. According to the preferred embodiment of the present invention, the lamp socket comprises a plastic socket shell, the plastic socket shell comprising a big opening and a small opening, a partition board and a metal socket body connected to the plastic socket shell, the partition board being disposed between the metal socket body and the plastic socket shell and having a metal spring plate mounted thereon, a metal block fixedly provided at one side of the plastic socket shell and connected to the metal socket body by rivet means for the connection of one AC wire, wherein the plastic socket shell comprises a rectangular chamber at a top side thereof, two through holes bilaterally disposed through the rectangular chamber, and two locating grooves at two opposite sides of the big opening; left metal contact unit and right metal contact unit respectively installed in the locating grooves in the plastic socket shell; a diode mounted in the rectangular chamber, having two opposite ends respectively fastened to the left metal contact unit and the right metal contact unit; a rotary switch control knob inserted through the small opening into the big opening and rotated between a first position where the lamp bulb which is installed in the metal socket body is off, a second position where electric current is directly transmitted to the lamp bulb and the lamp bulb is turned to a full light intensity status, and a third position where electric current is transmitted to the lamp bulb through the diode and the lamp bulb is turned to a half light intensity status.

DETAILED DESCRIPTION OF THE PREFERRED EMBODIMENT

Figure 1:
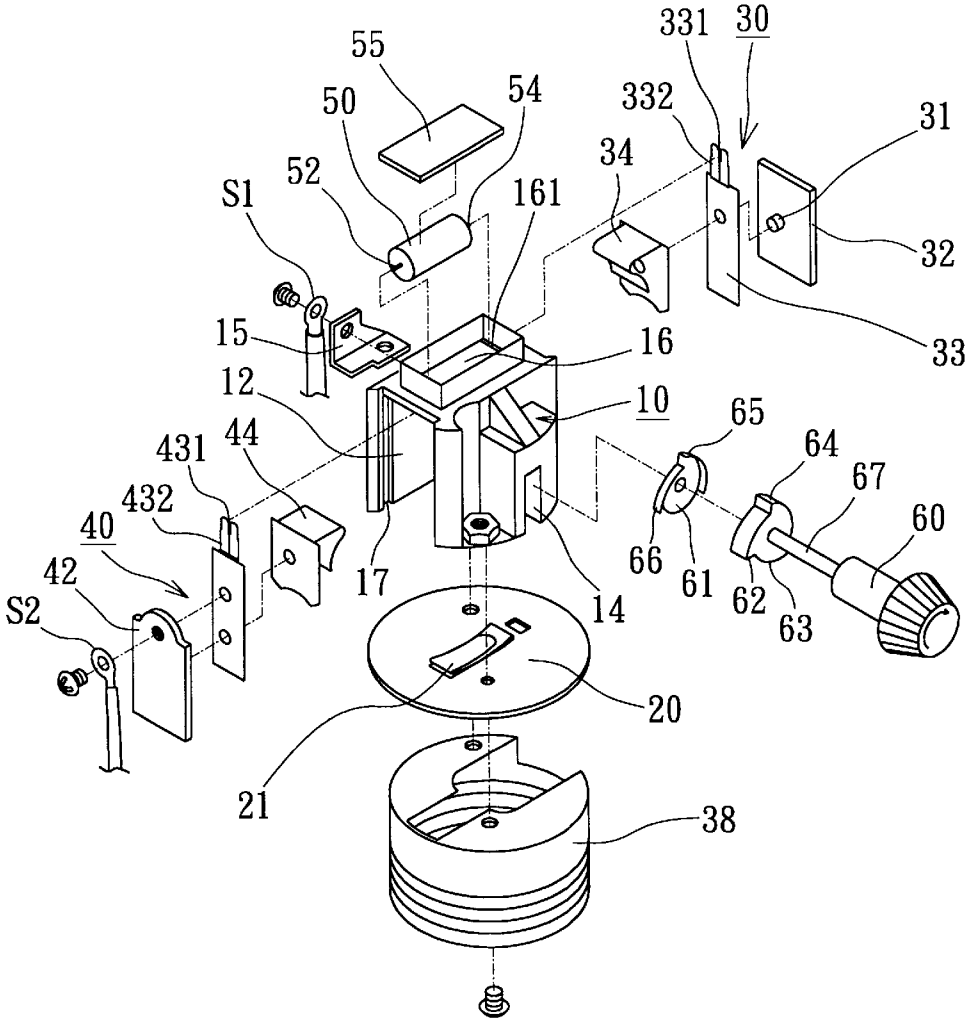
FIG. 1 is an exploded view of a lamp socket according to the present invention.
Figure 2:
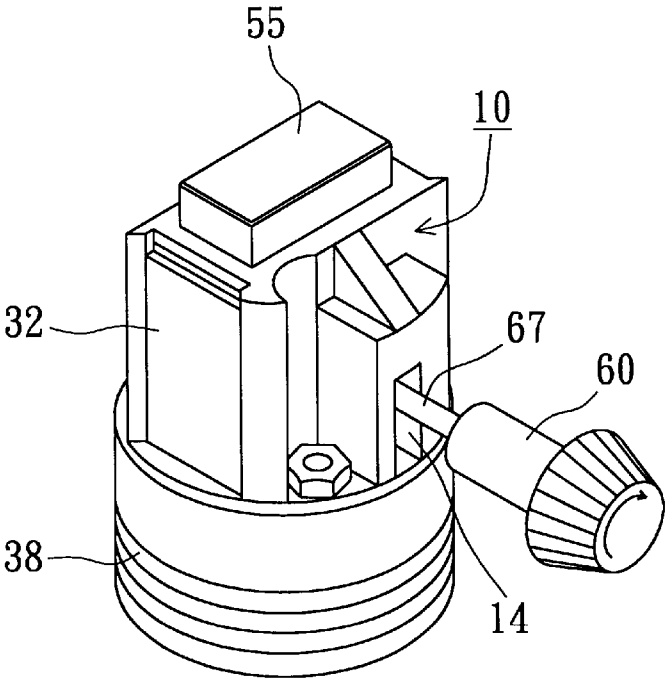
FIG. 2 is an elevational view of the lamp socket shown in FIG. 1.
Figure 3:
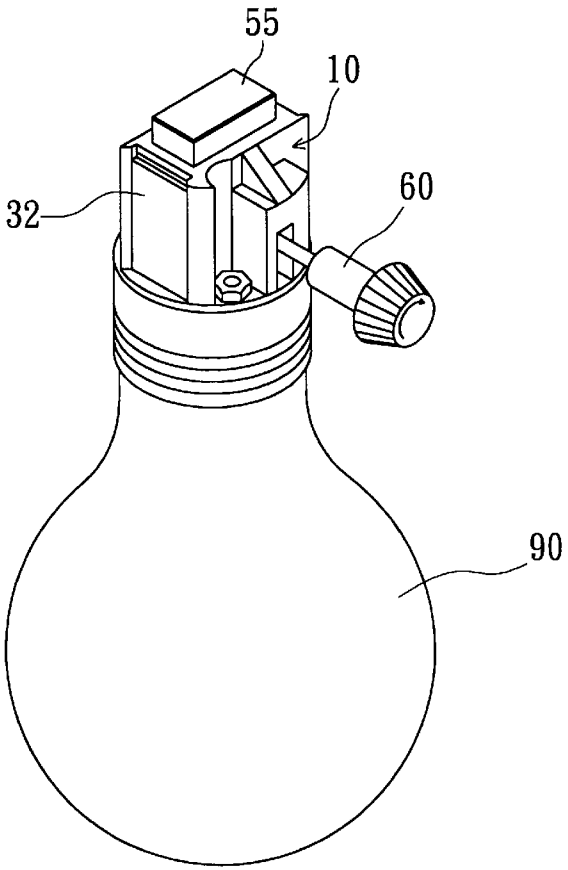
FIG. 3 shows a tungsten bulb installed in the lamp socket according to the present invention.
Figure 5:
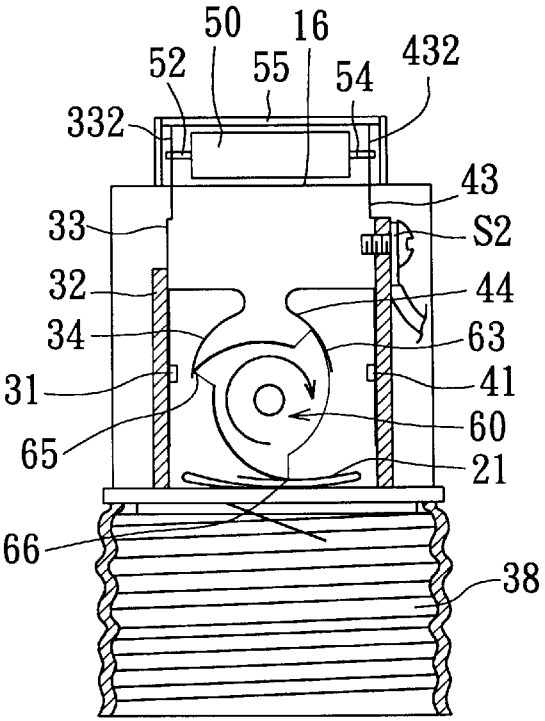
FIG. 5 is similar to FIG. 2 but showing the switch control knob turned to the second position.
Figure 4:
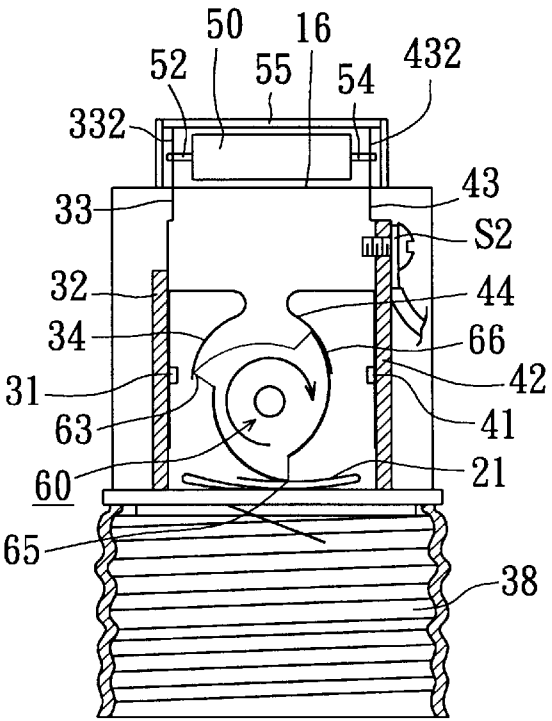
FIG. 4 is a sectional view of the present invention showing the switch control knob turned to the first position.

Referring to FIGS. From 1 through 3, a lamp socket in accordance with the present invention is generally comprised of:

- a plastic socket shell 10, the plastic socket shell 10 comprising a big opening 12 and a small opening 14, a rectangular chamber 16 at the top side thereof, two through holes 161 bilaterally disposed through the rectangular chamber 16, and two locating grooves 17 at two opposite sides of the big opening 12;
- a partition board 20 and a metal socket body 38 connected to the plastic socket shell 10 through a rivet (or screw joint), the partition board 20 being disposed between the metal socket body 38 and the plastic socket shell 10 and having a metal spring plate 21 mounted thereon;
- a metal block 15 fixedly provided at one side of the plastic socket shell 10 and connected to the metal socket body 38 by rivets means (or screw means);
- a first AC wire S1 connected to the metal block 15;
- a right metal contact unit 30 fastened to one locating groove 17, the right metal contact unit 30 comprising a locating plate 32 having a projecting rod 31 (see FIGS. 4 and 5), a terminal 33 and a metal spring plate 34 respectively fastened to the projecting rod 31, the terminal 33 having a tip 332 extended out of one through hole 161 into the rectangular chamber 16, the tip 332 having a gap 331;
- a left metal contact unit 40 fastened to one locating groove 17 opposite to the right metal contact unit 30, the left metal contact unit 40 comprising a locating plate 42 having a projecting rod 41 (see FIGS. 4 and 5), a terminal 43 and a metal spring plate 44 respectively fastened to the projecting rod 41, the terminal 43 having a tip 432 extended out of one through hole 161 into the rectangular chamber 16, the tip 432 having a gap 431;
- a diode 50 mounted in the chamber 16, having two ends 52 and 54 respectively fastened to the gaps 331 and 431 on the tips 332 and 432 of the terminals 33 and 43;
- a switch control knob 60, the switch control knob 60 comprising a shank 67 inserted through the small opening 14 into the big opening 12, and three electrically insulative arched projections 62, 63 and 64 radially disposed at one end of the shank 67 inside the socket shell 10;
- a metal shell 61 having two arched projections 65 and 66 respectively coupled to arched projections 62 and 64 of the switch control knob 60;
- a top cover plate 55 covered on the rectangular chamber 16; and
- a second AC wire S2 connected to the locating plate 42 of the left metal contact unit 40.

The operation of the present invention is outlined hereinafter with reference to FIGS. from 4 through 6. Rotating the switch control knob 60 clockwise causes the electrically insulative arched projections 63 and the electrically conductive arched projections 65 and 66 to contact the metal spring plate 44 of the left metal contact unit 40, the metal spring plate 21, and the metal spring plate 34 respectively, enabling electric current to be directly connected to the tungsten bulb 90 being fastened to the metal socket body 38, i.e., the diode 50 does no work, and the bulb 90 is turned on (see FIG. 4). Rotating the switch control knob 60 counterclockwise causes the electrically insulative arched projections 63 and the electrically conductive arched projections 65 and 66 to contact the metal spring plate 44 of the left metal contact unit 40, the metal spring plate 34 and the metal spring plate 21 respectively, enabling electric current to be connected to the diode 50 and then the tungsten bulb 90 to turn on the bulb

Figure 6:
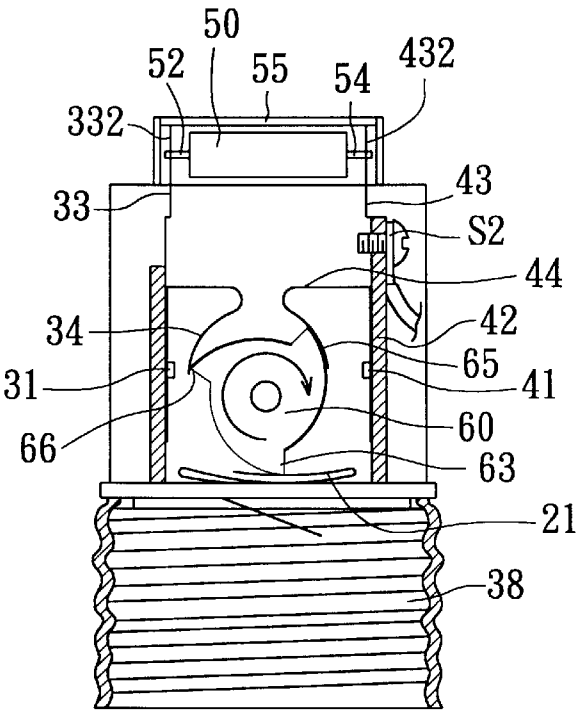
FIG. 6 is similar to FIG. 2 but showing the switch control knob turned to the third position.

90. Because of the voltage drop effect of the diode 50, the intensity of light of the bulb 90 is relatively reduced, i.e., the bulb 90 is in a low light intensity status at this stage. When continuously rotating the switch control knob 60 to force the electrically insulative arched projection 63 into contact with the metal spring plate 21, the bulb 90 is off (see FIG. 6).

Figure 7:
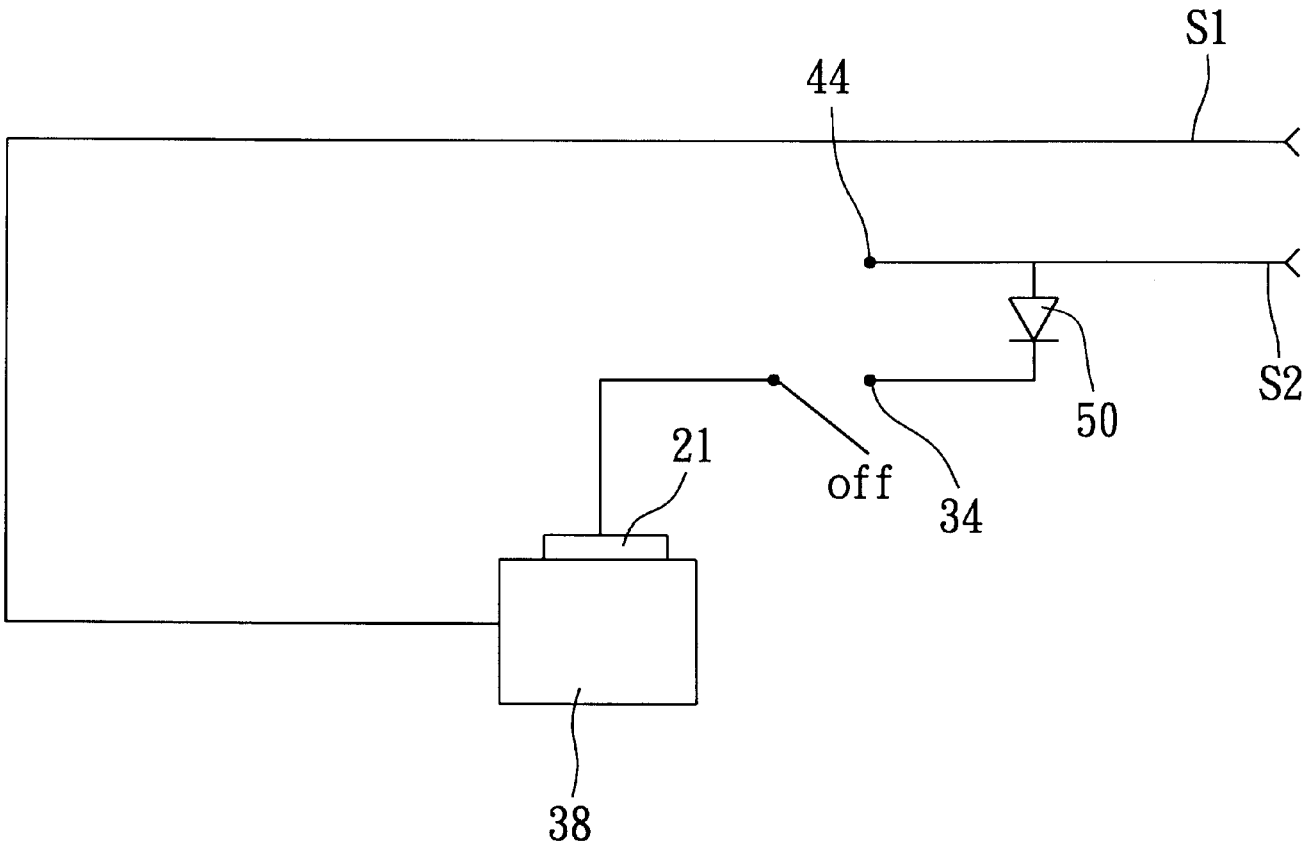
FIG. 7 is a simple circuit diagram of the present invention.
Figure 8:
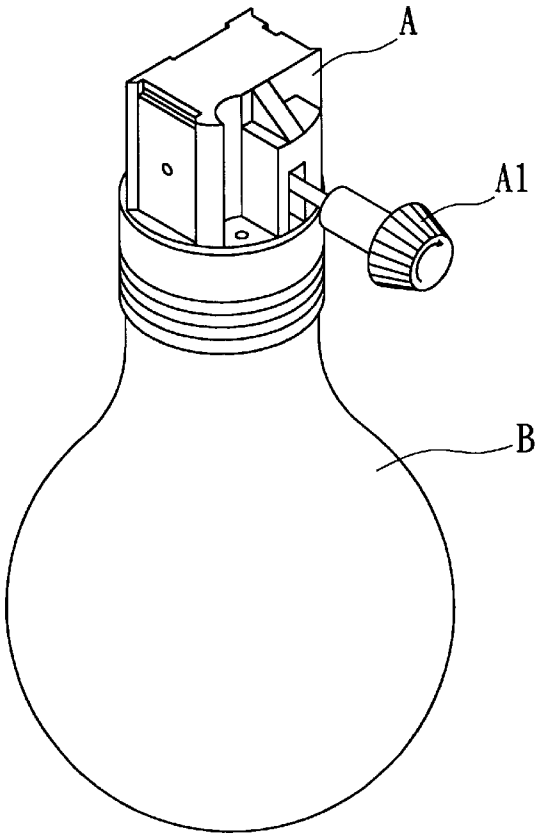
Fig. 8 (prior Art)
FIG. 8 illustrates a lamp socket according to the prior art.

FIG. 7 is a simple circuit diagram showing the relative positioning of the contact the metal spring plate 44, the metal spring plate 34, the metal spring plate 21, the diode 50, and the metal socket body 38.

What the invention claimed is:

1. A lamp socket comprising:

a plastic socket shell, said plastic socket shell comprising a big opening and a small opening, a partition board, and a metal socket body connected to said plastic socket shell; wherein said partition board is disposed between said metal socket body and said plastic socket shell, said partition board has a metal spring plate mounted thereon, a metal block is fixed to one side of said plastic socket shell, said metal block is connected to said metal socket body by rivet means so as to provide a connection of one AC wire, said plastic socket shell comprises a rectangular chamber at a top side thereof, two through holes are bilaterally disposed through said rectangular chamber, and two locating grooves are located at two opposite sides of said big opening, said locating grooves receive a left metal contact unit and a right metal contact unit, a diode is mounted in said rectangular chamber, a first end of said diode is connected to said left metal contact unit and a second end of said diode is connected to said right metal contact unit, a rotary switch control knob is inserted through said small opening into said big opening; and wherein said left metal contact unit and said right metal contact unit each comprise a locating plate having a projecting rod, a terminal, and a metal spring plate fastened to said projecting rod, said terminal having a tip extended out of one through hole into the rectangular chamber of said plastic socket shell, said tip having a gap which receives one end of said diode.

2. The lamp socket of claim 1 wherein:

said rotary switch control knob comprises a shank inserted through said small opening into said big opening in said plastic socket shell, and three electrically insulating arched projections radially disposed at one end of said shank inside said plastic socket shell.

3. The lamp socket of claim 1 wherein: a top cover plate covers said rectangular chamber of said plastic socket shell.

4. The lamp socket of claim 1 wherein:

a second AC wire is connected to said locating plate of said left metal contact unit.

* * * * *